US005331700A

United States Patent [19]

Kärcher et al.

[11] Patent Number: 5,331,700

[45] Date of Patent: Jul. 26, 1994

[54] BRIDGING SYSTEM CONSISTING OF TRACK SUPPORTS

[75] Inventors: Hans-Jürgen Kärcher, Karben; Walter Kinzel, Mainz, both of Fed. Rep. of Germany

[73] Assignee: Man Gutehoffnungshütte AG, Oberhausen, Fed. Rep. of Germany

[21] Appl. No.: 927,121

[22] Filed: Aug. 7, 1992

[30] Foreign Application Priority Data

Aug. 8, 1991 [DE] Fed. Rep. of Germany ..... 4126250

[51] Int. Cl.[5] ..... E01D 15/12

[52] U.S. Cl. ..... 14/2.4; 14/10; 14/14

[58] Field of Search ..... 14/4, 5, 9, 10, 15, 14/73.5, 2.4.73.1, 2.5, 2.6, 13, 14, 24, 69.5; 404/50, 54, 67–69; 52/573

[56] References Cited

U.S. PATENT DOCUMENTS

| | | | |
|---|---|---|---|
| 3,827,817 | 8/1974 | Czernik | 404/67 |
| 3,851,989 | 12/1974 | Prach | 404/50 |
| 4,353,190 | 10/1982 | Gleeson | 14/5 X |
| 4,972,538 | 11/1990 | Parramore | 14/2.4 X |
| 5,042,101 | 8/1991 | Huether | 14/5 X |
| 5,067,297 | 11/1991 | Sobol | 404/56 X |
| 5,113,543 | 5/1992 | Sevenet | 14/24 |
| 5,173,981 | 12/1992 | Hasselkvist | 14/2.4 |

FOREIGN PATENT DOCUMENTS

| | | | |
|---|---|---|---|
| 2360277 | 6/1975 | Fed. Rep. of Germany | 404/50 |
| 2597129 | 10/1987 | France | 14/2.4 |
| 2611682 | 9/1988 | France | 414/401 |

*Primary Examiner*—Ramon S. Britts
*Assistant Examiner*—James A. Lisehora
*Attorney, Agent, or Firm*—Max Fogiel

[57] ABSTRACT

The invention concerns a bridging system comprising several uniform bridge section in the form of track supports (1). The width of the bridge can be continuously adjusted with telescoping pipes ( 2 ). The stationary ramps ( 3 ) on the track support are slotted like a comb and, once the have been assembled and connected to the pivoted-out lower truss system (4), can accommodate any compression forces and bending moments that occur when traveled. Since each track support is the same shape, the bridging system has a smoothly curving upper roadway edge.

The traction component (5) in each track support travels back and forth between pivoting stays (9) provided with connectors (8) and the overall lower truss system can be pivoted into the track support.

This bridging system, which consists of modular track supports (1), is outstanding for its compact traveling state and few connectors and can be positioned by appropriate transporting and laying equipment.

8 Claims, 4 Drawing Sheets

BRIDGING SYSTEM CONSISTING OF TRACK SUPPORTS

BACKGROUND OF THE INVENTION

The invention concerns a bridging system consisting of several uniform bridge sections in the form of track supports. One bridge section or several bridge sections together constitute a bridge.

A take-apart latticework bridge is known from German 3 814 502. Its modular components comprise two roadway slabs connected by transverse girders.

One bridge component consists of two roadway slabs, two lower flanges, and eight diagonal struts. The diagonal struts and lower flanges in each bridge component telescope and can be locked into position.

The diagonal struts can be rotated to unlock them. Once it has been pulled apart or pushed together, the rod can be locked back into another position by being rotated into another groove.

Assembling a bridge 14 m long from two bridge components requires much rotating to unlock and relock eight diagonal struts.

A 40 m long bridge will then consist for example of six bridge components, and 40 diagonal struts will have to be rotated many times to unlock and relock them during disassembly, and a total of eight diagonal struts, two per bridge component, will have to be dismounted. This approach to assembling bridge components demands an enormous expenditure of time.

SUMMARY OF THE INVENTION

The object of the present invention is a bridging system, especially one that can be rapidly extended across excavations, rivers, etc., consists of modular sections, is compact when transported, has few and simple joints, and can be positioned by bridge-laying equipment.

This object is attained in accordance with the invention as described in the claims.

The bridging system in accordance with the invention has several advantages over the known systems.

- The width of the bridge can be continuously varied between a maximal and a minimal track width.
- The bridge component's ramps have slots like a comb's to accommodate the compression and corresponding bending moments that occur when several track supports are inserted together and cantilevered forward.
- The bridge component is shaped longitudinally like a fishbelly girder, resulting not only in a statically practical shape but also in a longitudinally continuously curved upper roadway edge when the bridge is assembled from several pairs of track supports inserted together, allowing it to be more easily traveled than a polygonally designed bridge by low-clearance vehicles.

BRIEF DESCRIPTION OF THE DRAWINGS

The invention will now be specified with reference to five figures.

DESCRIPTION OF THE PREFERRED EMBODIMENTS

Figure 1:
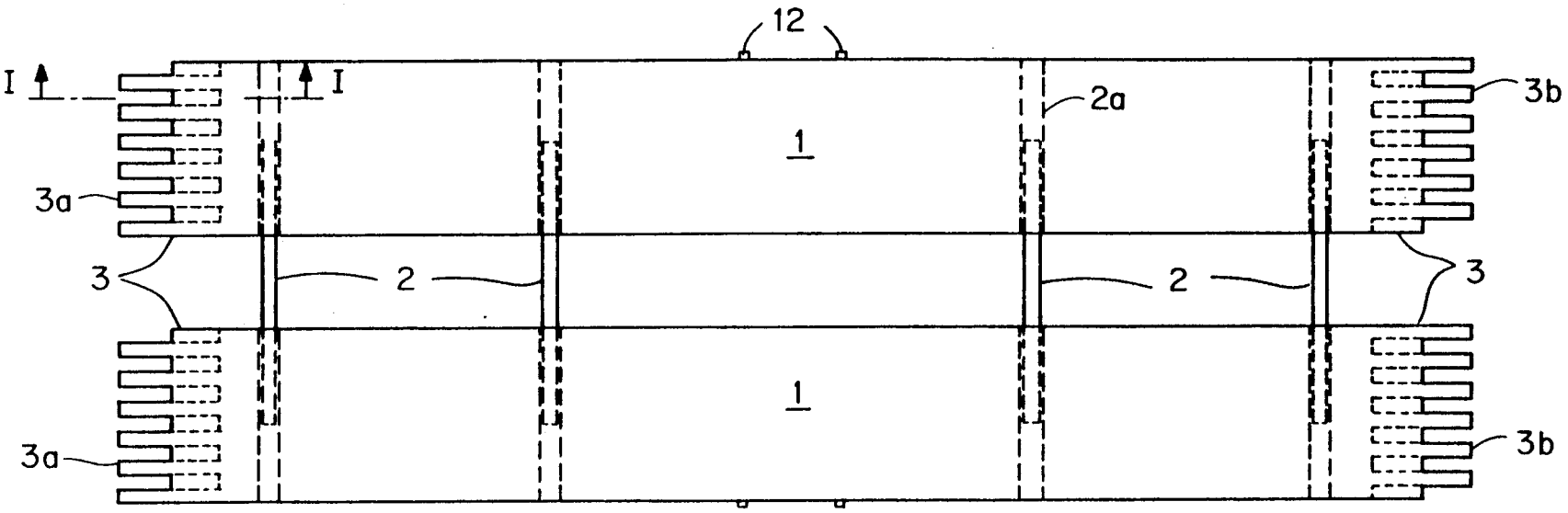
FIG. 1 is a top view of a bridge section consisting of track supports.

FIG. 1 is a top view of a bridge section with two parallel track supports 1, each stationary end 3 of which has slots like a comb's, and four different transverse telescoping pipes 2, each extending through an opening 13 in the inner wall of a track support 1 and engaging tubular fasteners 2*a*.

Figure 2:
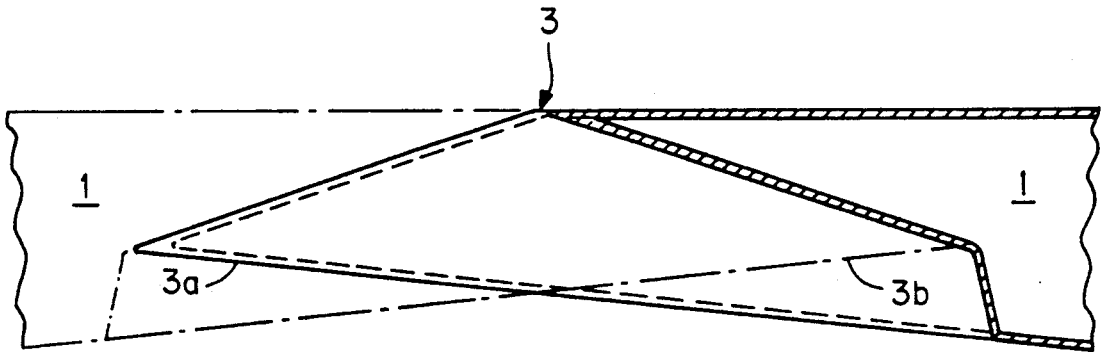
FIG. 2 is a section along the line I—I illustrating a slot like a comb's in the stationary ramp at the end of the track support.

FIG. 2 is a section along the line I—I through the slot 3 in the stationary ramp at the end of track support 1. Unillustrated niches to accommodate the stops at the ends of the cable are advantageously provided in the vicinity of the comb-like ends 3 of track supports 1.

Figure 3:
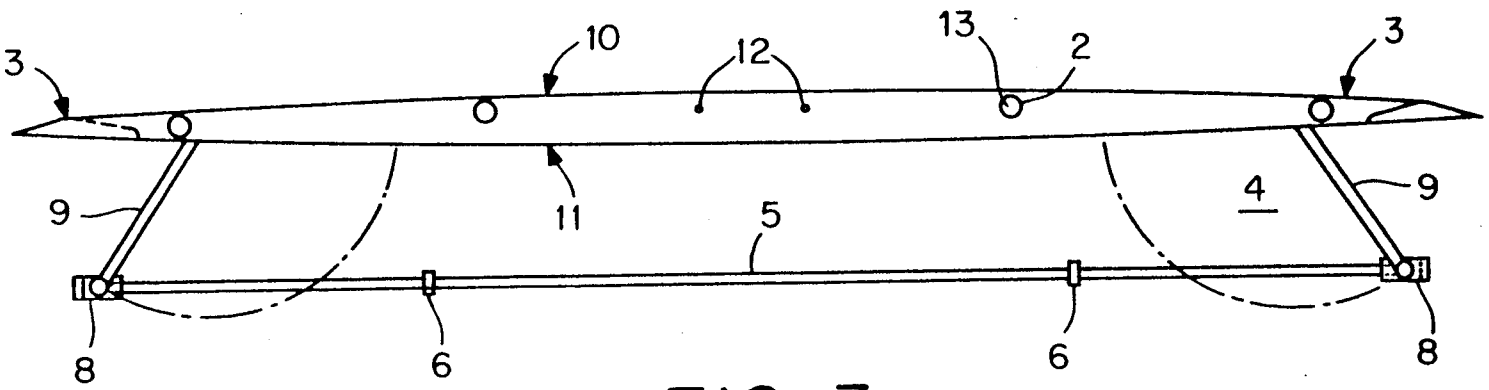
FIG. 3 is a side view of a track support with the lower truss system swung into position.

FIG. 3 is a side view of track support 1 with stays 9 pivoted into position. The fishbelly constituted by the upper edge 10 and lower edge 11 of the track support 1 between its ends 3 is evident. The high-strength traction cable 5 in lower truss system 4 slides back and forth through connectors 8 in pivoting stays 9. The stops 6 on traction cable 5 between pivoting stays 9 are intended to prevent the cable from dropping out of one end through a connector 8 when the lower truss system is folded up and making it more difficult to accommodate in track support 1. Retainers 12 are preferably positioned on the outer longitudinal wall at the middle of track support I and are intended to maintain, retain, accommodate, and expand track support 1 in unillustrated appropriate transporting and laying equipment.

Pivoting stays 9, connectors 8, and traction cable 5 are pivoted into track support 1 while the components are being transported.

Figure 4:
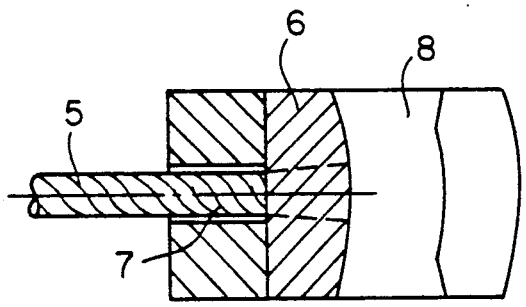
FIG. 4 is a section through a longitudinally displaceable bearing for the traction cable with a stop inside the joint.

FIG. 4 is a section through the longitudinally displaceable bearing for the high-strength traction cable 5 in connectors 8 with a stop 6 at the end 7 of the cable.

Figure 5:
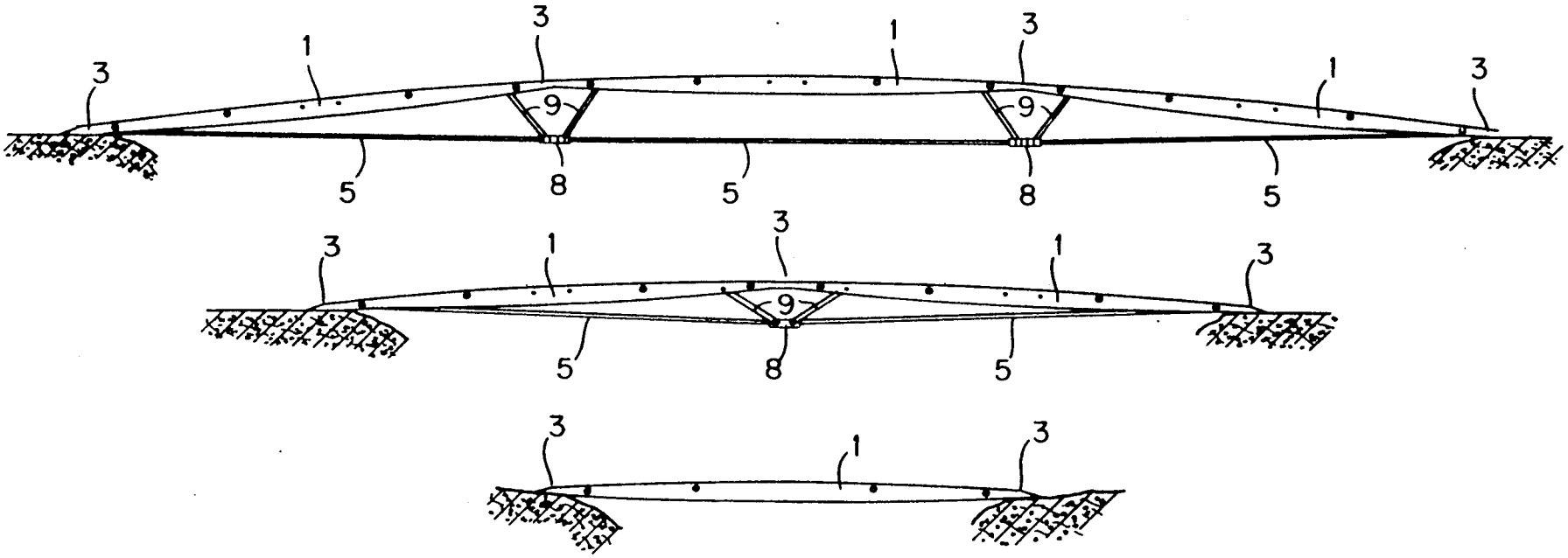
FIG. 5 is a side view of bridges of three different lengths.

FIG. 5 is a side view of bridges of three different lengths. The bridge at the top consists of three bridge sections 1 and the bridge in the middle of two sections 1 with mutually engaging lower truss systems 4. The bridge at the bottom of FIG. 5 consists of a single span with no lower truss system 4 pivoted out.

I claim:

1. A bridging system comprising: a plurality of uniform bridge sections having track supports, at least one bridge section being a bridge; transverse telescoping pipes connecting said track supports; a stationary ramp having comb-shaped slots at each end of a track support to form prong-shaped projections, when ends of two track supports are joined, adjacent prong-shaped projections on said ramp on one track support engage another oppositely-lying track support, and prong-shaped projections on said other track support engage said one track support; said prong-shaped projections being engaged without becoming wedged-in and said track supports being freely connectable in a vertical plane.

2. A bridging system as defined in claim 1, wherein each track support has an upper edge and a lower edge as well as ends and a center, a distance between said upper edge and said lower edge increasing uniformly from said ends to said center of the track support, so that said track support has a shape of a fish belly beam.

3. A bridging system as defined in claim 1, including tubular fasteners on said track supports, said telescoping pipes being inserted in said tubular fasteners.

4. A bridging system as defined in claim 1, wherein each track support has a bottom and an in-pivoting lower truss system on said bottom; a traction component with an end and stop means at said end in said lower truss system; pivoting stays with connectors pivotable on said track support, said connectors pivoting on said pivoting stays and connecting to said traction component, said traction component sliding through said connectors in said pivoting stays, said stop means blocking said truss in a pivoted-out position of said stays and transmitting forces from said stays to said truss, said stop means holding said truss within a contour of the track support in a pivoted-in position of said stays, said lower truss system being capable of receiving compressive forces and bending moments when a vehicle drives over said bridging system.

5. A bridging system comprising: a plurality of uniform bridge sections having track supports, at least one bridge section being a bridge; transverse telescoping pipes connecting said track supports; a stationary ramp having comb-shaped slots at each end of a track support to form prong-shaped projections, when ends of two track supports are joined, adjacent prong-shaped projections on said ramp on one track support engage a bottom of another oppositely-lying track support, and prong-shaped projections on said other track support engage a bottom of said one track support; said prong-shaped projections being engaged without becoming wedged-in and said track supports being freely connectable in a vertical plane.

6. A bridging system comprising: a plurality of uniform bridge sections having track supports, at least one bridge section being a bridge; transverse telescoping pipes connecting said track supports; a stationary ramp having comb-shaped slots at each end of a track support to form prong-shaped projections, when ends of two track supports are joined, adjacent prong-shaped projections on said ramp on one track support engage another oppositely-lying track support, and prong-shaped projections on said other track support engage said one track support; each track support having a lower truss system; pivoting stays with connectors; a traction cable with stop means between said pivoting stays, said pivoting stays resting against said connectors when said lower truss system is pivoted into said track supports; said prong-shaped projections being engaged without becoming wedged-in and said track supports being freely connectable in a vertical plane.

7. A bridging system as defined in claim 6, wherein each track support has an upper edge and a lower edge as well as ends and a center, a distance between said upper edge and said lower edge increasing uniformly from said ends to said center of the track support, so that said track support has a shape of a fish belly beam.

8. A bridging system as defined in claim 6, including tubular fasteners on said track supports, said telescoping pipes being inserted in said tubular fasteners.

* * * * *